US012618650B2

(12) United States Patent
De Las Fuentes Gutiérrez et al.

(10) Patent No.: US 12,618,650 B2
(45) Date of Patent: May 5, 2026

(54) PORTABLE TARGET STAND

(71) Applicants: Diego De Las Fuentes Gutiérrez, Guadalajara (ES); Dalton Rafael Jiménez Coronel, Alicante (ES)

(72) Inventors: Diego De Las Fuentes Gutiérrez, Guadalajara (ES); Dalton Rafael Jiménez Coronel, Alicante (ES)

(73) Assignees: Diego De Las Fuentes Guiterrez, Guadalajara (ES); Dalton Jimenez Coronel, Alicante (ES)

( * ) Notice: Subject to any disclaimer, the term of this patent is extended or adjusted under 35 U.S.C. 154(b) by 469 days.

(21) Appl. No.: 18/212,300

(22) Filed: Jun. 21, 2023

(65) Prior Publication Data

US 2024/0426583 A1 Dec. 26, 2024

(51) Int. Cl.
*F41J 1/10* (2006.01)

(52) U.S. Cl.
CPC ..... *F41J 1/10* (2013.01)

(58) Field of Classification Search
CPC ..... F41J 1/10
USPC ..... 273/407
See application file for complete search history.

(56) References Cited

U.S. PATENT DOCUMENTS

| | | | | |
|---|---|---|---|---|
| 5,441,267 | A * | 8/1995 | Alder | G09F 17/00 473/173 |
| 5,503,356 | A | 4/1996 | Shelby | |
| D549,749 | S * | 8/2007 | Francis | D15/141 |
| 8,176,665 | B2 | 5/2012 | Petrovic | |
| 8,955,846 | B2 | 2/2015 | Frickey | |
| 9,476,173 | B1 * | 10/2016 | Wielenga | F16M 11/245 |
| 9,618,292 | B1 * | 4/2017 | Hancosky | F41A 25/00 |
| 10,295,315 | B2 | 5/2019 | Harris et al. | |
| D899,629 | S * | 10/2020 | Hanlon | D25/67 |
| 12,410,632 | B2 * | 9/2025 | Touhey | E04H 15/48 |
| 2001/0001912 | A1 * | 5/2001 | Weaver | F41A 27/08 42/94 |
| 2011/0154703 | A1 * | 6/2011 | Petrovic | G09F 15/0068 40/606.13 |
| 2015/0069191 | A1 * | 3/2015 | Filseth | B60N 2/2854 248/164 |
| 2018/0071604 | A1 * | 3/2018 | Tyndall | A63B 63/00 |
| 2019/0186874 | A1 | 6/2019 | Taub | |
| 2022/0349681 | A1 * | 11/2022 | Zhang | F41J 1/10 |
| 2024/0149428 | A1 * | 5/2024 | Szumer | B25H 1/06 |
| 2025/0237079 | A1 * | 7/2025 | Falk | E04H 15/06 |

* cited by examiner

*Primary Examiner* — Allyson N Trail
(74) *Attorney, Agent, or Firm* — Tucker Ellis LLP

(57) ABSTRACT

A portable target stand includes a base aimed to be deployed over a surface in a usage position. The base includes an elongated body, extending horizontally between a first end and a second end, opposite said first end, in said usage position, and four legs. The body includes target attaching means, configured to attach at least one target assembly thereto. The target assembly includes means for holding at least a target. Each of said legs includes a first portion, attached to said body so that is horizontally tiltable between a first folded position wherein said first portion is folded to said body, and a first extended position wherein said first portion is tilted away laterally from said body. Each of said legs further includes a second portion, attached to said first portion so that is vertically tiltable between a second folded position.

20 Claims, 7 Drawing Sheets

PORTABLE TARGET STAND

FIELD OF THE INVENTION

The invention lies in the field of stands for target, for example, those dedicated to support targets for aiming and shooting practice.

In particular, the invention relates to a portable target stand comprising a base aimed to be deployed over a surface in a usage position.

Background

Target stands are used for supporting targets form aiming practice, for example, for shooting firearms, arrows, or the like. Typical stands known in the art are fixed structures that provide a good stability but that are difficult to transport and manipulate. For this reason, some other solutions of foldable stands have been developed. Examples of these type of target stands are diverse in the art, the most usual being trestles to tripods. For example, U.S. Pat. No. 10,295,315 discloses a trestle-like target stand with four foldable legs. U.S. Pat. No. 5,503,356 discloses a tripod-like target stand having three foldable legs. These types of *stans* are portable, they can be unfolded and deployed over a surface and, when the aiming session finishes, they can be folded back so they can be transported, stored, or moved to another location.

However, in these types of stands, the structure is still large to be easily transported even when folded. Another problem is the lack of adaptation to the terrain or surface where the stand has to be deployed. U.S. Pat. No. 8,955,846 discloses a tripod stand having a base with three foldable legs and yoke gimbal assembly that allows to deploy the base in an uneven terrain and support the target in a vertical position. U.S. Pat. No. 8,176,665 discloses stands having a base having an elongated body and a leg formed in a single piece articulately joined at the middle, so it can be horizontally unfolded in a X-like shape or folded against the body for storage and transportation. Several bases may be jointly used in order to improve stability. Even if the aforementioned examples provide improved transportation and storage capabilities, the adaptation to the terrain is still limited.

A further problem of many of the stands known in the art is that the required rigidity and stability often requires using metallic parts. In particular, in the case of targets for firearm shooting practice, when a projectile impacts a metallic part, it can generate shards that may fly away and be a potential risk. US20190186874 deals with this shortcoming by using a stand formed by flat pieces of multilayer polymeric material that can be assembled together, the pieces having a low-density polymer foam in the centre, so it can absorb impacts without creating shards. The resulting stand, however, is not suitable for being deployed in uneven terrains and the type of targets it can support is limited.

SUMMARY OF THE INVENTION

The invention is aimed to provide portable target stand of the type stated at the beginning, being able to avoid the problems that have been identified above.

This purpose is achieved by a portable target stand of the type indicated at the beginning, wherein said base comprises:

an elongated body, extending horizontally between a first end and a second end, opposite said first end, in said usage position; and four legs;

said body having target attaching means, configured to attach at least one target assembly thereto, wherein said target assembly comprises means for holding at least a target;

each of said legs comprising:

- a first portion, attached to said body so that is horizontally tiltable between a first folded position wherein said first portion is folded to said body, and a first extended position wherein said first portion is tilted away laterally from said body; and
- a second portion, attached to said first portion so that is vertically tiltable between a second folded position wherein said second portion is folded to said first portion, and a second extended position wherein said second portion is tilted away downwards from said first portion in an angle of at least 90°.

The base may therefore be deployed showing a front side that will usually be directed towards the location of the person who is practicing shooting, and a back side opposite the front side. Each of the four legs have two portions: the first portion is articulated regarding the body and can be folded and unfolded horizontally with respect to the body, while the second portion is articulated regarding the first portion and can be folded and unfolded vertically with respect to the first portion. As a non-limiting example, one end of the first portion of each leg may be attached near one to the ends of the body by an articulation element, and the other end of the first portion may be attached to one end of the second portion of the leg by another articulation element. This way, when unfolded, the free end of the second portion may be in contact with the surface where the base is deployed. Since each portion of each leg may be unfolded independently and into different angles, the resulting stand may be easily adapted to uneven surfaces, even to stairs. At the same time, because all the legs fold regarding themselves and to the body, the stand may be folded into a compact shape that it is easy to transport and store.

Preferably, each of said second portions is provided with a through-hole configured to allow the passage of a fixing element, for example, a nail or a bolt, for fixing said base to said surface, thereby improving the stability.

Preferably, each of said legs is formed independently of one another, therefore, the legs do not share parts in common and may be actuated independently and even replaced independently from one another.

Preferably, each of said first portions are horizontally tiltable independent from one another, so that each leg can be folded and unfolded independently form one another. As an alternative, the legs may be associated in pairs, so one of the legs in a pair may be unfolded until one leg comes full-tilt against the other leg of the pair. This effect may also be obtained by the presence of a stopping element arranged between the legs as it will be shown in the latter examples and figures.

Preferably, each of said second portions are vertically tiltable independent from one another, so they can be folded and unfolded independently from one another, therefore improving possibilities of adaptation to the surface where the portable stand will be deployed.

Preferably, in said first extended position said first portion is tilted away laterally from said body in an angle of at least 120°.

Preferably, in said second extended position said second portion is tilted away downwards from said first portion in an angle of 165°, so that to obtain a range of angles that may be adapted to the surface and that, when the surface is completely flat and horizontal, the body remains a bit elevated over said surface.

Preferably, each of said first portions are each lockable at least in said first folded position and/or said first extended position. The possibility of looking the first portions in the folded position facilitates the transportation and storage, while the possibility of locking in the unfolded position improves stability when deployed. Preferably, each of said second portions are each lockable at least in said second folded position and/or said second extended position, with equivalent effects to the ones regarding the first portions.

Preferably, each of said first portions are each lockable in at least one first tilted position between said first folded position and said first extended position, i.e., in an intermediate position, and more preferably in several intermediate positions, so that it is possible to improve the stability in a plurality of intermediate angles, thereby increasing the flexibility to adapt to uneven surfaces and terrains. Likewise, in a preferred embodiment, each of said second portions are each lockable in at least one second tilted position between said second folded position and said second extended position.

Preferably, in each leg, said first portion is attached to said second portion by means of a toothed hirth-like joint, having two parallel disks, each having teeth that extend towards the other disk, so that the teeth of both disks are confronted and engage with each other to lock the joint into position. This is a particularly advantageous type of joint that allows to position the second portion in the desired tilted position and safely block it into position, preventing undesired rotation afterwards.

Preferably, said hirth-like joint has a manually operable locking element of at least 2 cm wide, so it can be manually operated even without using dedicated tools. A size of at least 3.5 cm is advantageous for operating the locking element with gloves.

Preferably, each leg has a graded angle display scale comprising a scale of values at regular intervals, so that each value corresponds to a tilting angle of said second portion, so that each second portion may be tilted to the exact angle, if necessary, for example, if the surface is completely flat it may be necessary that all the second portions are positioned to the same angle.

Preferably, each of said first portions and, therefore, each leg, is attached to said body by means of a swivel attachment, so that the first portions can be folded and unfolded in their respective positions. Different options for the swivel attachment may be envisaged, for example, those based on a screw inserted in one end of the first portion. Other embodiments will be discussed hereinafter.

Preferably, each of said swivel attachments has a manually operable locking element of at least 2 cm wide, so that it can be manipulated without dedicated tools. A size of at least 3.5 cm is advantageous for operating the locking element with gloves.

Preferably, said body comprises:

- a first swivel attachment proximate to said first end of the body; and
- a second swivel attachment proximate to said second end of the body;

wherein said four legs are grouped in two pairs of legs, a first pair of legs of said four legs, attached to said first swivel attachment, and a second pair of legs of said four legs, attached to said second swivel attachment. This way, each end of the body has two legs attached therein, only two swivel attachments are necessary, and the resulting device is also compact, in particular, when folded. In this case, the use of the word "proximate" refers to the cases when the swivel attachment is located at the end of the body, which is a preferred embodiment, or else at a small distance from said end corresponding to less than 20% of the overall length of the body.

Preferably, said elongated body comprises:

- a central part;
- a first end part comprising said first swivel attachment; and
- a second end part comprising said second swivel attachment;

wherein each of said first end part and said second end part are removably attachable to said central part by means of respective end part securing means. This construction based in removable part allows the easy substitution of a part when it has been damaged, for example, due to the impact of a projectile. Each end part may therefore be attached and detached from the central part when necessary. The modular design further improves the manufacturing and stock control of the components. Moreover, it makes possible to use different configurations for the portable stand, for example, substituting the central part with another having electronic devices that allow for further features as it will be discussed later on this document.

Preferably, each of said end part securing means comprises a dovetail junction and a lock, which provides a secure attaching mechanism, but which is also easy to operate.

Preferably, for each pair of legs of said two pairs of legs, one leg of said pair of legs, in particular, the corresponding first portion, is horizontally tiltable from said first folded position to said first extended position in a forward direction, and the other leg of said pair of legs is horizontally tiltable from said first folded position to said first extended position in a backward direction, contrary to said forward direction, so that each leg of each pair of legs folds and unfolds in the opposite direction regarding the other leg of the pair, one forwards and one backwards. The side identified as the front of the elongated body is the one facing the practicing shooter in a normal usage position, and the back is the opposite side. Therefore, the directions identified with the words "forward" and "backward" have been referred to said front and back sides. The skilled person will understand that the word "direction" corresponds to the beginning of the movement when the leg starts to tilt from the folded position towards the unfolded position and is, therefore, parallel to the tangent of the curved line described by the leg at the point corresponding to the initial position.

Preferably, for each pair of legs of said two pairs of legs, it is provided an angular stopper configured to prevent the angle between said legs from being less than a predefined minimum angle, so that each leg of said pair of legs is horizontally tiltable independent from one another if the angle between each leg of said pair of legs is greater than said predefined angle between legs. As a non-limiting example, said stopper may be an abutment provided in the first portions of the legs proximate to the corresponding swivel attachment. Once one leg is tilted so that it reaches the stopper, said leg interferes with the other and, if it continues to be tilted away, it also tilts the other leg of the pair (towards its respective folded position) provided that the second leg is tilted in a range of angles that allow said movement. This preferred embodiment grants a minimum separation between the legs, thereby improving the stability of the portable target stand. Moreover, once the two legs of the pair are in contact, there is an additional contact point which further improves said stability.

Preferably, said predefined minimum angle is 120°, which has been found to be an adequate compromise between flexibility of position and stability for most of the situations.

Preferably, each swivel attachment of said first swivel attachment and said second swivel attachment comprises a top threaded part and a bottom threaded part, screwable with each other in a mounted position, thereby forming a vertical empty cylinder having a central axis, said empty cylinder opened to the exterior at least in a top side of said elongated body so that a mounting hole accessible by said top side is formed, wherein said central axis of said vertical cylinder is also the axis of rotation around which each leg of the pair of legs attached to the swivel attachment can be tilted;

wherein said target attaching means comprises:

a first mounting hole, being the mounting hole corresponding to said first swivel attachment; and a second mounting hole, being the mounting hole corresponding to said second swivel attachment.

In this preferred embodiment, each swivel attachment comprises two threaded parts that can be screwed together in order to lock the corresponding pair of legs into a particular position. When the two parts of a swivel attachment are screwed together, a cylindrical mounting hole is defined in the top side, and this mounting hole acts as part of the target attachment means for the portable target stand. This configuration provides a simple structure that minimizes the number of elements and is still robust and easy to assemble and disassemble. In a preferred embodiment the top threaded part and bottom threaded part have a diameter of at least 35 mm in order to be manually operable without the need of dedicated tools, and even with gloves.

Preferably, the portable target stand further comprises a target assembly that comprises a first pole and a second pole, wherein, in a mounted position, said first pole is inserted in said first mounting hole, and said second pole is inserted in said second mounting hole, said poles configured for holding a target between them. If the poles are straight vertical elements, it necessary that the distance between the first and second mounting holes is adequate for the size of the target that will be hold in between. The modular structure discussed above is a particularly preferred combination with this embodiment since it allows to obtain longer or shorter portable stands depending on the sizes of the modules that can be assembled.

Preferably, each of said first pole and said second pole is formed by at least two tubes that can be assembled together, thereby facilitating the adaptation to different heights of the target, and also minimizing the space necessary for storage and transport when disassembled.

Preferably, the portable target stand further comprises a target assembly that comprises a first clamp and a second clamp, each clamp having a bottom straight mounting part and top clamping part, wherein, in a mounted position, said straight mounting part of said first clamp is inserted in said first mounting hole, and said straight mounting part of said second clamp is inserted in said second mounting hole, said clamps configured for holding a target between them. This is a preferred embodiment for rigid targets that do not need a supporting structure, for example, those made of a sheet Expanded Polystyrene, EPS.

Preferably, each of said clamping parts has the general shape of an inverted R, which facilitates the insertion of rigid targets of the type described above.

Preferably, said target attaching means comprise a central mounting hole provided in a top side of said elongated body, so that it provides flexibility regarding the type of target assembly. Preferably, said central mounting hole is threaded, so that the target assembly it can be secured therein.

Preferably, the portable target stand further comprises a pendulum target assembly that comprises a U-shaped holding structure configured to hold a target, said holding structure connected to a counterweight, and rotatably attached to a vertical fork, so that it can oscillate vertically;

said target assembly further comprising a ball joint, having:

a ball connected to a bottom shaft which is configured to be inserted in said central mounting hole;

an upper part; and a clamp, configured to clamp the upper part to the ball;

wherein said vertical fork is attached to said upper part of said ball joint.

The target assembly disclosed herein is suitable for being used with the base of the portable target stand of the invention, but it can also be used with other types of target stands. The configuration is advantageous to adapt the target stand and target assembly to uneven surfaces, for example, in cases where the rake to the floor cannot be totally compensated by the legs of the base. The ball joint of the target assembly allows to position the target in vertical position so that the pendular movement is not impinged by the conditions of the terrain and the target and counterweight can function as expected. Pendulum targets allow shooting practice with targets that are not in a fixed position but oscillate, thereby increasing the difficulty.

Preferably, said target assembly further comprises a level indicating means, configured to show the inclination of said upper part of said ball joint, so that the compensation for any angle of inclination can be easily read and corrected.

Preferably, said level indicating means comprises a spirit level. This type of level indicating means has the advantage of a low manufacturing cost but also can be free of metal parts that could create potentially dangerous shards when receiving an impact.

Preferably, said counterweigh comprises a pole, said pole comprising one or more weight elements that can be assembled together thereby forming said pole. The modular counterweight is particularly advantageous because it allows to select the speed of the pendular motion of the target.

Preferably, said target assembly further comprises a locking bracket comprising:

a first L-shaped end, configured to engage with said counterweight of said target assembly;

a second U-shaped end, configured to engage with said elongated body; and a straight pole connecting said first L-shaped end and said second U-shaped end;

wherein, in a mounted position, said holding structure and said counterweight are in a horizontal position, and said locking bracket is vertically arranged between the elongated body and the counterweight thus securing said counterweight in a horizontal position. Therefore, the portable target stand is deployed with the target in a horizontal position, and the target is held in place by the locking bracket. Once the locking bracket is removed, the target starts to oscillate in the pendular motion. The upper L-shaped end facilitates the release of the locking bracket while the second U-shaped end helps to keep the locking bracket in place with the elongated body when securing the target assembly horizontally. Preferably, said straight pole comprises an intermediate articulation, so that the upper part of the pole can be tilted backwards thereby facilitating releasing the target assembly.

Preferably, said target assembly further comprises a releasing actuator, configured to throw down said locking bracket, thereby releasing said counterweight, wherein said releasing actuator comprises at least one of:

a secondary target attached to said straight pole; and a cord attached to one end of said locking bracket.

These options provide remote access to the locking bracket, either by a shot on the secondary target or by pulling the cord attached to the locking bracket.

Preferably, said elongated body further comprises a control module shielded inside said elongated body, said control module being configured for performing at least one of:

activating or deactivating at least one light provided in said body;

activating or deactivating at least one laser pointer provided in said body;

driving at least one speaker provided in said body to emit at least one sound;

activating a releasing actuator which in turn throws down a locking bracket thereby releasing a counterweight of a pendulum target assembly; and activating a releasing actuator which in turns pulls down a locking latch from one of its ends, thereby releasing a holding structure of a pendulum target assembly.

The control module may be shielded, for example, by a block of high-density material or metal provided in front of the control module and protecting it from potential damaging shots. The presence of a control module allows several advantageous features that provide a more complete and realistic shooting practice experience, from activating lights directed to the person practicing shooting, playing some environmental or simulated combat sounds, etc. The control module may also be used to initiate the pendular movement of a pendulum target assembly by releasing the locking bracket or the locking latch.

Preferably, said target assembly further comprises a locking latch, provided in said U-shaped holding structure of said target assembly and configured for engaging with said vertical fork thus securing said U-shaped holding structure in a horizontal position. This is a minimized design that can be used for holding the structure in place without the need for external elements. Depending on the position of the latch and the way to engage with the fork, the U-shaped holding structure may be secured perfectly horizontally or with a small angle diverging from the horizontal.

Preferably, said locking latch is rotatably mounted to said U-shaped holding structure and has an unlocked position wherein said locking latch is folded to the U-shaped holding structure and retained thereto by at least one magnet, and a locked position wherein said locking latch extends perpendicularly to the U-shaped holding structure. The magnet or magnets help to keep the latch in position when folded so that the pendulum target assembly can oscillate.

Preferably, said target assembly further comprises a releasing actuator, configured to pull down said locking latch from one of its ends, so that said locking latch is moved from said locked position to said unlocked position, thereby releasing said U-shaped holding structure, wherein said releasing actuator comprises a cord configured to be attached to one end of said locking latch. Similar to the case of the locking bracket, the cord may pull the locking latch, releasing the target assembly that starts oscillating. In this case, a preferred embodiment is using a control module that drives the cord, for example, by releasing a spring that pulls the cord.

Preferably, said target stand further comprises a rotatory vertical target assembly that comprises a U-shaped holding structure configured to hold a target, said holding structure comprising two vertical poles and a horizontal bottom part; said target assembly further comprising a rotatory module configured to be inserted in said central mounting hole and having:

attaching means, configured for removably attaching said bottom part; and rotatory means, configured for rotating around a vertical axis, thereby driving said U-shaped holding structure to rotate around said vertical axis;

wherein said elongated body is provided with rotation driving means configured to drive said rotatory means to rotate. Preferably, said rotation driving means are controlled by a control module.

Preferably, said control module is configured for performing at least one pre-defined sequence, so that the additional features described above can be activated following said sequence.

Preferably, said at least one pre-defined sequence is programmable, so it can be changed by the user.

Preferably, said at least one pre-defined sequence is selected between a collection of sequences, so it can be chosen by the user between a plurality of possible sequences, or even between predefined sequences and other that the user has programmed in the control module.

Preferably, said control module is remotely activated and/or remotely controllable, so that the user can access remotely to the control module without going near the target stand. Several options may be envisaged for the remote control support, non-limiting examples are infra-red, IR, controls, using external devices communicating by wired or wireless technologies such as mobile phone data networks, Wi-Fi, Bluetooth, etc. The remote controller may also be a dedicated device, a smart device with a dedicated application installed therein or other equivalent solutions.

Preferably, the portable target stand is manufactured using mainly plastic materials, in particular, in rigid plastic materials. These types of materials are less prone to create dangerous shards when receiving an impact, thereby improving the safety of the shooting practice.

Preferably, said at least one plastic material has at least all but one of the following properties:

Young's Modulus: 0.1 to 2.9 Giga Pascals, GPa

Tensile Resistance: 10 to 80 Mega Pascals, MPa

Shear Modulus: 85 to 100 Mega Pascals, MPa

Shore Hardness (D scale): 50 to 80

Glass-transition Temperature: −125 to 40° C.

After extensive testing, it has been found that the materials having all the aforementioned properties are particularly well suited for maintaining the structural properties after impacts and minimizing the risks of creating potentially dangerous shards. Even materials having all but one of these properties have been found as suitable candidates for manufacturing the portable target stand and, in particular, the base.

Preferably, said plastic materials are at least one of:

nylon;

polyethylene;

polypropylene;

acrylonitrile butadiene styrene (ABS); and polyvinyl chloride (PVC) foam.

After several test, it has been found that these materials are the best suited for creating a portable target stand because they can resist several impacts with minimal deformation and without creating dangerous shards. Among the different materials listed above, it has been found that the best suited are nylon, polyethylene, and polypropylene.

Preferably, each of the parts of the portable target stand has a width and height of at least 12 mm, therefore reducing the risk of breakage when receiving an impact of standard 9 mm ammunition.

The invention also includes other detail features illustrated in the detailed description of some embodiments of the invention and in the accompanying figures.

BRIEF DESCRIPTION OF THE FIGURES

Further advantages and features of the invention will become apparent from the following description, in which, without any limiting character, preferred embodiments of the invention are disclosed, in reference to the accompanying figures.

DETAILED DESCRIPTION OF EMBODIMENTS OF THE INVENTION

Figure 1:
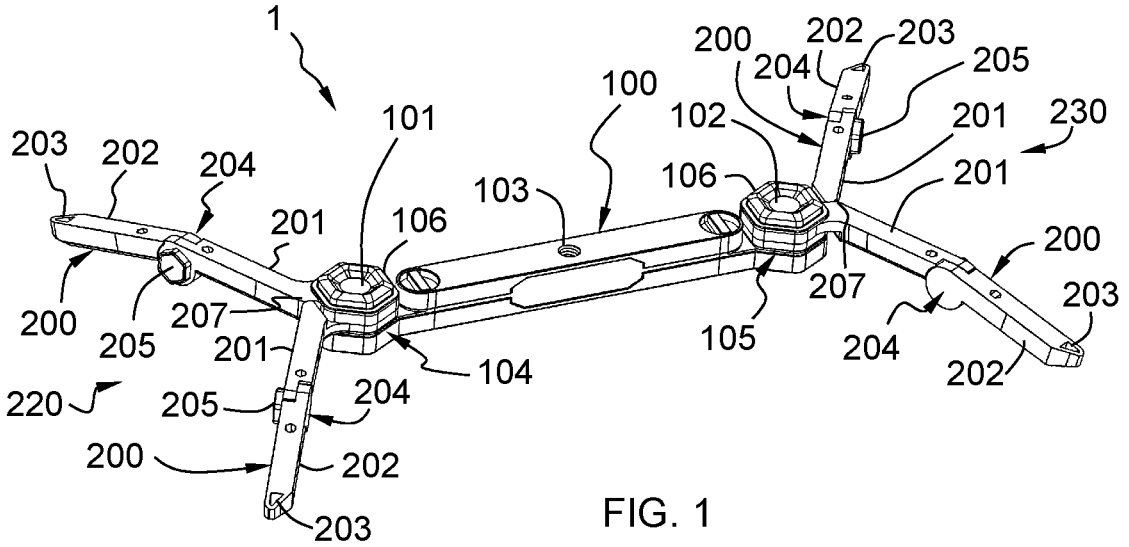
FIG. 1 is a perspective view of the portable target stand according one embodiment of the invention; the figure shows the stand with the four legs unfolded.
Figure 2:
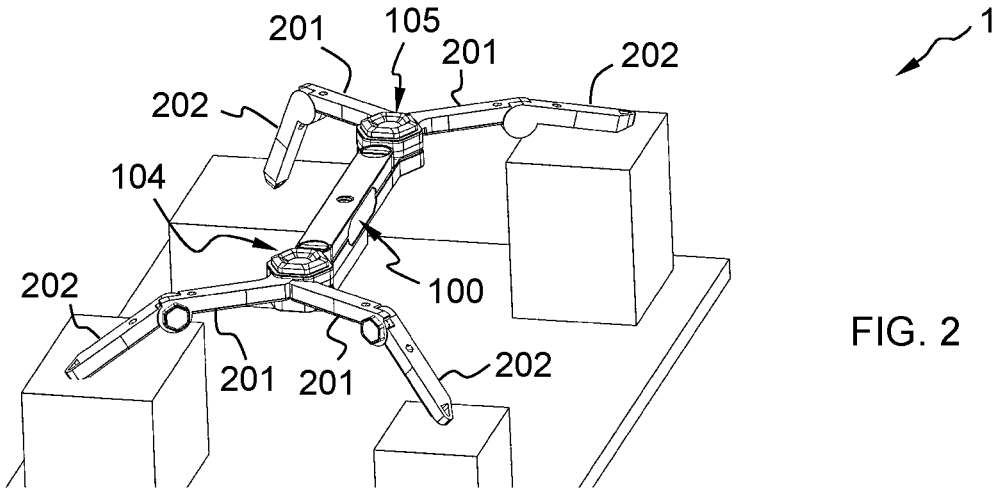
FIG. 2 shows an example of the portable target stand of FIG. 1 deployed over an uneven surface in the usage position.

FIGS. 1 to 9 show a first exemplary embodiment of the portable target stand 1 of the invention. The figures show a portable target stand 1 comprising a base aimed to be deployed over a surface in a usage position. As shown in FIG. 2, the surface may be uneven, however, for the sake of clarity, in most of the figures the base is displayed as it is deployed on a perfectly flat surface.

Figure 3:
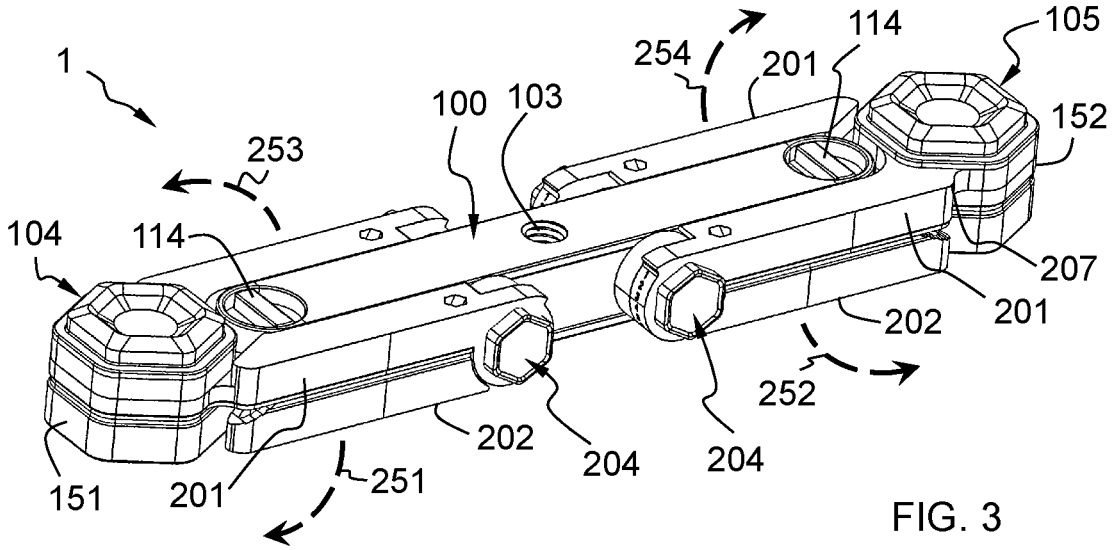
FIG. 3 is a perspective view of the portable target stand of FIG. 1 showing the target stand with the four legs folded.

The base comprises four legs 200 attached to an elongated body 100. FIG. 1 shows the portable target stand 1 deployed with the four legs 200 extended, and FIG. 3 shows the same target stand 1 but with the legs 200 folded. FIG. 2 shows an exemplary usage position over an uneven surface. When deployed in the usage position, as shown in FIG. 1 and FIG. 3, the body extends horizontally between a first end 151 and a second end 152, opposite said first end 151. The first end 151 and second end 152 are not necessarily predetermined and may be arbitrary. However, a general convention has been used in the figures for the sake of clarity and brevity. Unless otherwise indicated, in the examples shown in the figures the front side is considered the one that usually faces the person practicing shooting. From that user's perspective, the first end 151 of the body has been assigned to the left end, and the second end 152 of the body has been assigned to the right end. The body 100 of the first exemplary embodiment has target attaching means 101, 102, 103, that are configured to attach target assemblies 300 thereto. Each of said target assemblies 300, in turn, having means for holding a target 400. The stand 1 further comprises a threaded central mounting hole 103 provided in a top side of said elongated body 100. A cover may be used when the central mounting hole 103 is not being used, as shown in the exploded view of FIG. 4

Each of the four legs 200 is formed independently from one another and comprises two portions: a first portion 201, which is the one that is attached to the body 100, and a second portion 202, attached to the first portion 201, and having a through-hole 203 that allows the passage of a fixing element, for example, a nail or bolt, for helping fixing he base 100 to the surface. The attachment between the first portion 201 and the body is done by means of a swivel attachment 104, 105, so that each first portion 201 can be horizontally tilted between a folded position shown in FIG. 3, wherein the first portion 201 is folded to the body 100, and an extended position show in FIG. 1 or FIG. 2. The attachment between portions 201, 202 allows the portions to be folded against each other. Therefore, each of the second portions 202 can be vertically tilted between a folded position shown in FIG. 3, wherein the second portion 202 is folded to the first portion 201, to an extended position as shown in FIG. 1. Each second portion 202 is vertically tiltable independently from one another. Starting from the folded position, the second portion 202 can be tilted downwards until an angle of 90°. In the first exemplary embodiment, the second portion 202 can be further tilted away until the position regarding the first portion 201 is 165°. However, other possible maximum angles may be envisaged, in particular in the range of 90-180°.

Figure 4:
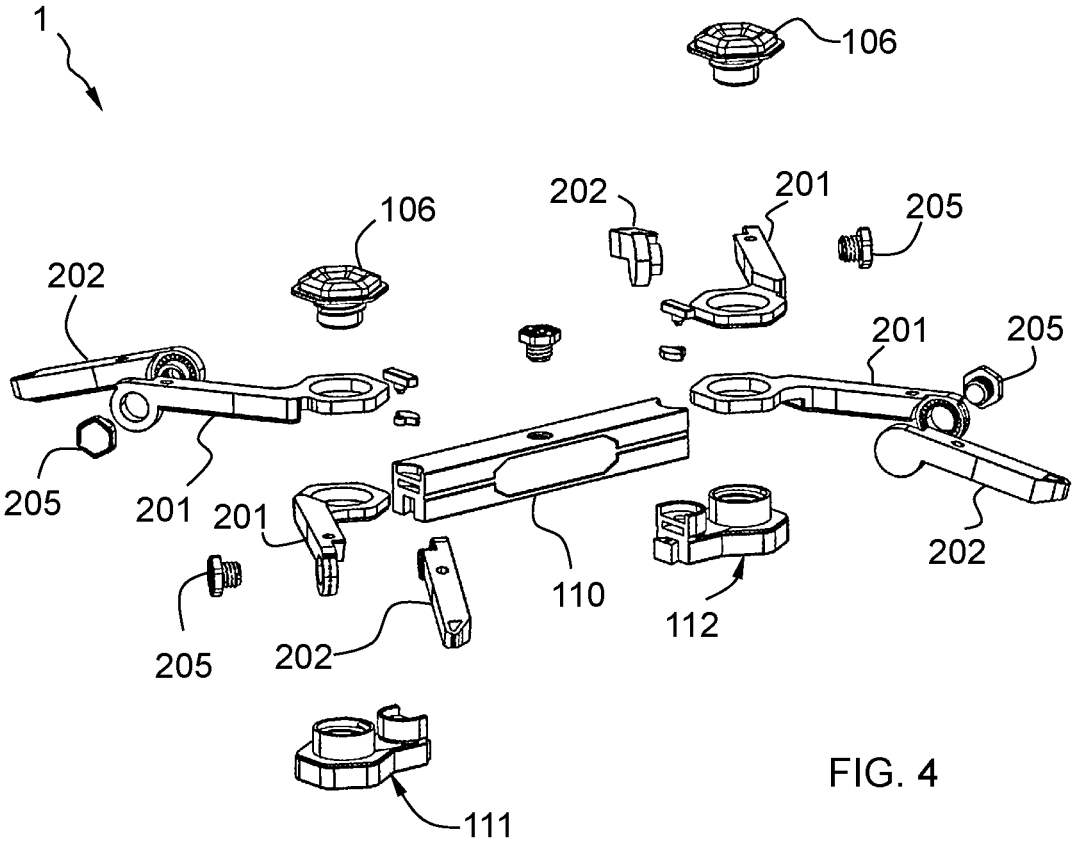
FIG. 4 is an exploded view of the portable target stand of FIG. 1.
Figure 5:
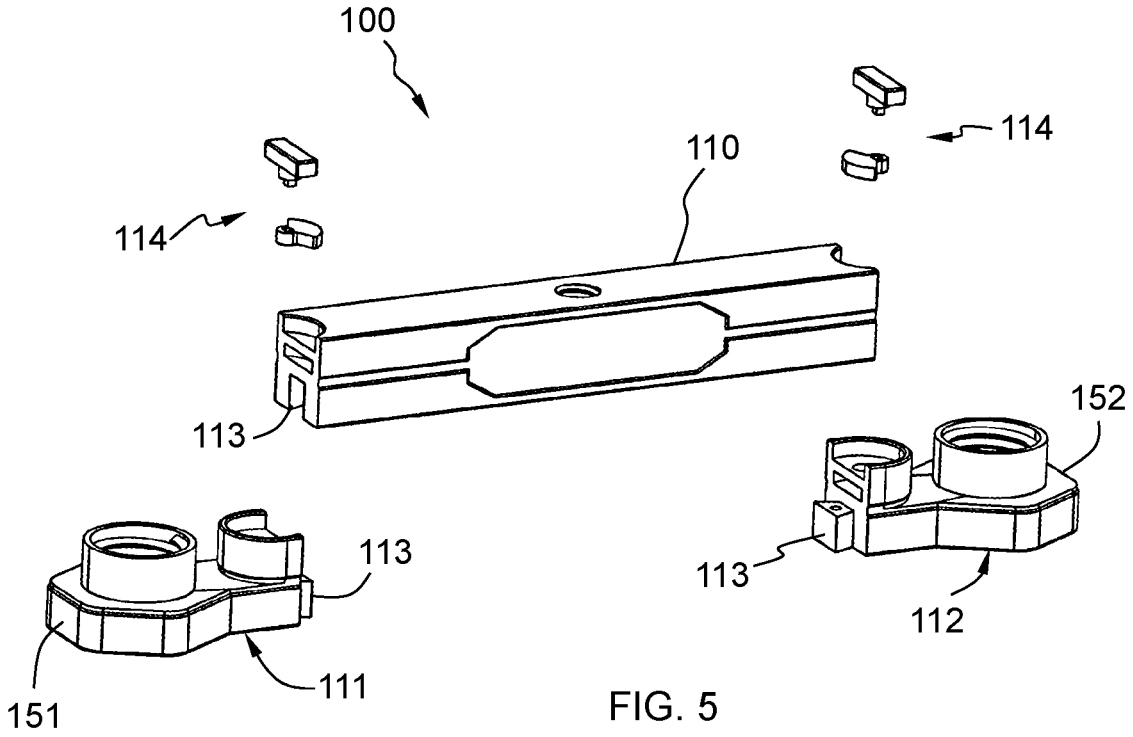
FIG. 5 is an exploded detail view of the attachment means for the central module of the body of the portable target stand.

As shown in FIG. 1 and FIG. 3, in the first exemplary embodiment, the body 100 comprises a first swivel attachment 104 proximate to said first end 151 of the body 100; and a second swivel attachment 105 proximate to said second end 152. A first pair of legs 220 is attached to the first swivel attachment 104, and a second pair of legs is attached to the second swivel attachment 105. The first and second pairs of legs 220, 230 are independent from one another, so that they can also be folded and unfolded independently. FIGS. 4 and 5 show that the elongated body 100 has a central part 110, a first end part 111 comprising said first swivel attachment 104, and a second end part 112 comprising said second swivel attachment 105. Both the first end part 111 and the second end part 112 are removably attachable to the central part 110 by means of respective end part securing means, comprising a dovetail junction 113 and a lock 114, the lock having a manual actuator switch having a size of 2 cm or more. Other end part securing means may be envisaged, for example, using bolts. However, the combination of features of the first exemplary embodiment are particularly advantageous because the body can be assembled and disassembled manually without using dedicated tools.

Figure 6:
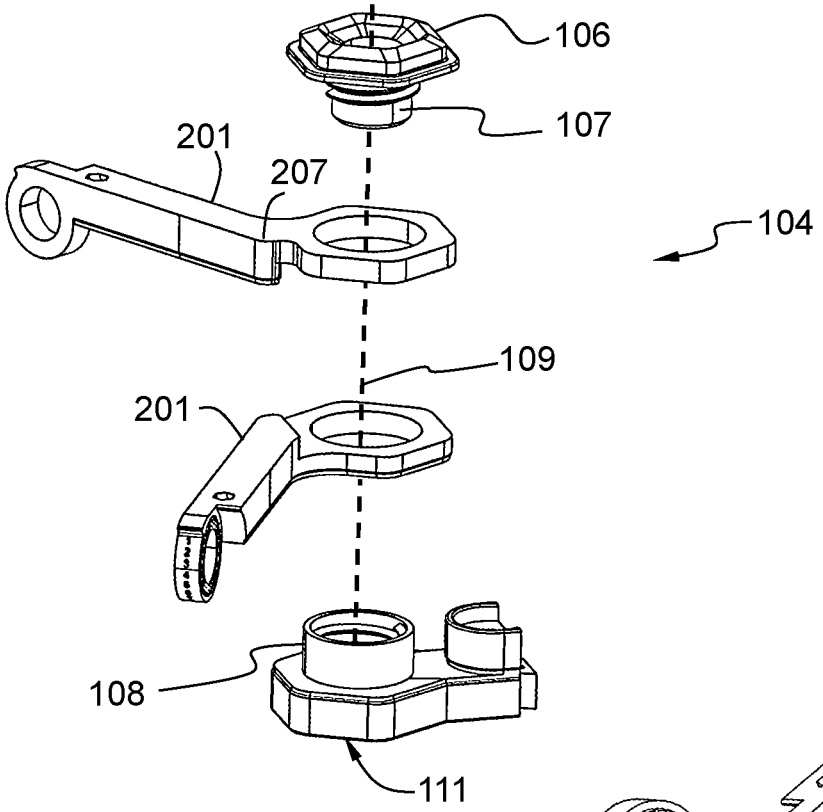
FIG. 6 is an exploded detail view of one of the swivel attachments and the first portions of one pair of legs.

FIG. 6 shows an exploded view of the detail of one of the swivel attachments 104 and how the first portions 201 of its respective pair of legs 220 are attached. The other swivel attachment 105 is symmetrical, as shown in FIG. 4. Each swivel attachment 104, 105 has a top threaded part 107 and a bottom threaded part 108, screwable with each other in a mounted position. When in the mounted position, a vertical empty cylinder having a central axis 109 is formed. Said empty cylinder is opened to the exterior in the top side of said elongated body 100, thereby forming the corresponding mounting hole 101, 102. In particular, the first swivel attachment 104 corresponds to a first mounting hole 101, and the second swivel attachment 105 corresponds to a second mounting hole.

The central axis 109 of said vertical cylinder is also the axis of rotation around which each first portion 201 of each leg of the pair of legs 220, 230 attached to the swivel attachment 104, 105 rotates, so it can be tilted between the folded and expanded positions. In particular, as it has been represented in FIG. 3 by means of a slashed arrow lines, for each leg of each pair of legs 220, 230, one leg is horizontally tiltable from the first folded position to the first extended position in a forward direction 251, 252, and the other leg of the pair of legs is horizontally tiltable from the first folded position to the first extended position in a backward direction 253, 254, contrary to said forward direction. The legs of one pair can be folded an unfolded independently from the other pair. However, for each pair 220, 230, it is provided an angular stopper 207 in the form of an abutment in the first portion 201 of one of the legs that prevents the angle between said legs of said pair of legs from being less than a predefined minimum angle of 120°. Other angles may be envisaged, preferably in the range of 180-0°. Therefore, each leg of the pair is horizontally tiltable independent from the other leg of the pair if the angle between them is greater than said predefined angle between legs. Once the predefined angle is reached, as shown in FIG. 1, the abutment 207 of one leg impedes the movement of the other leg. In the figure, both legs of the pair are tilted 120° regarding the body 100, and they are 120° from each other. Once in the desired position, the legs of one pair of legs 220, 230 can be locked in position by tightening the threaded parts 107, 108 of the corresponding swivel attachment 104, 105 by means of a manually operable locking element 106. The locking element 106 has a hexagonal shape wherein each parallel edge is separated 86.59 mm and each contrary vertex is separated 95.35 mm, so that it can be manually operated easily.

Figure 7:
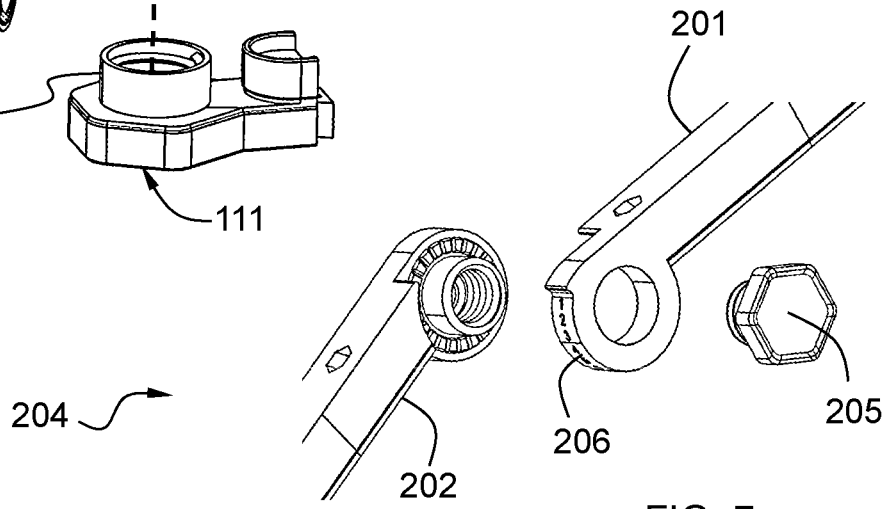
FIG. 7 is an exploded detail view of the attachment between the first portion and the second of a leg, from a first perspective.
Figure 8:
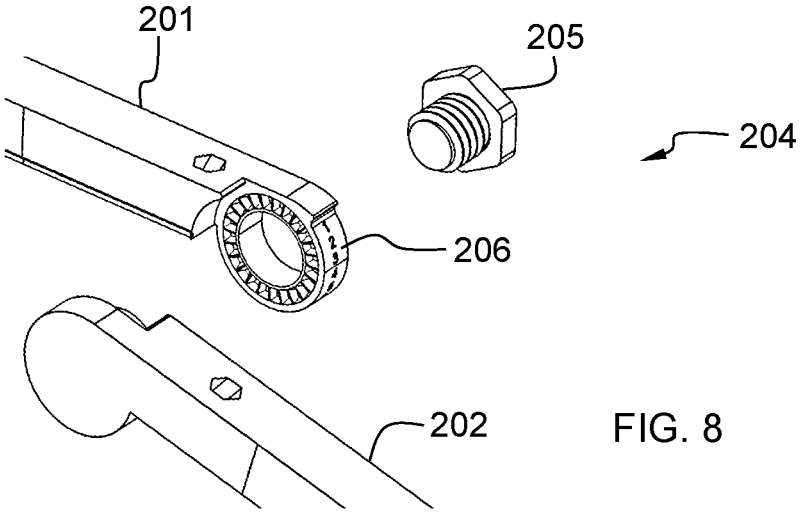
FIG. 8 is an exploded detail view of the attachment between the first portion and the second of a leg of FIG. 7, from a second perspective.

FIG. 7 and FIG. 8 are two detailed views of the same details from different perspectives. They correspond to the attachment between a first portion 201 of a leg to a second portion 202. In particular, for the first exemplary embodiment, both portions 201, 202 are attached by means of a toothed hirth-like joint 204. The two portions can be locked in the desired tilted or folded position by means a manually operable locking element 205 that is 2 cm wide or more. As shown in FIG. 7 and FIG. 8, each leg 200 has a graded angle display scale 206 comprising a scale of values at regular intervals, so that each value corresponds to a tilting angle of said second portion 202. In the case of the first exemplary embodiment the scale of values is an equally spaced list of natural numbers starting by 1 that may be used as a reference. Each number corresponds to an angle, but it is not the direct measure of the angle, for example, each number may correspond to an increment of 5°.

In the first exemplary embodiment, the portable target stand 1 is manufactured using a plastic material, in particular in nylon and/or polyethylene and/or polypropylene. However, other plastic materials may be envisaged, as non-limiting examples: acrylonitrile butadiene styrene or polyvinyl chloride foam. Besides, each of the parts of the portable target stand 1 has a width and height of at least 12.5 mm.

Other embodiments of the portable target stand 1 according to the invention are disclosed hereinafter. These embodiments share most of the features disclosed in the first embodiment above. Therefore, only the differentiating features will be described in detail. For the sake of brevity, common features shared with the first embodiment disclosed above will not be described again hereinbelow.

Figure 9:
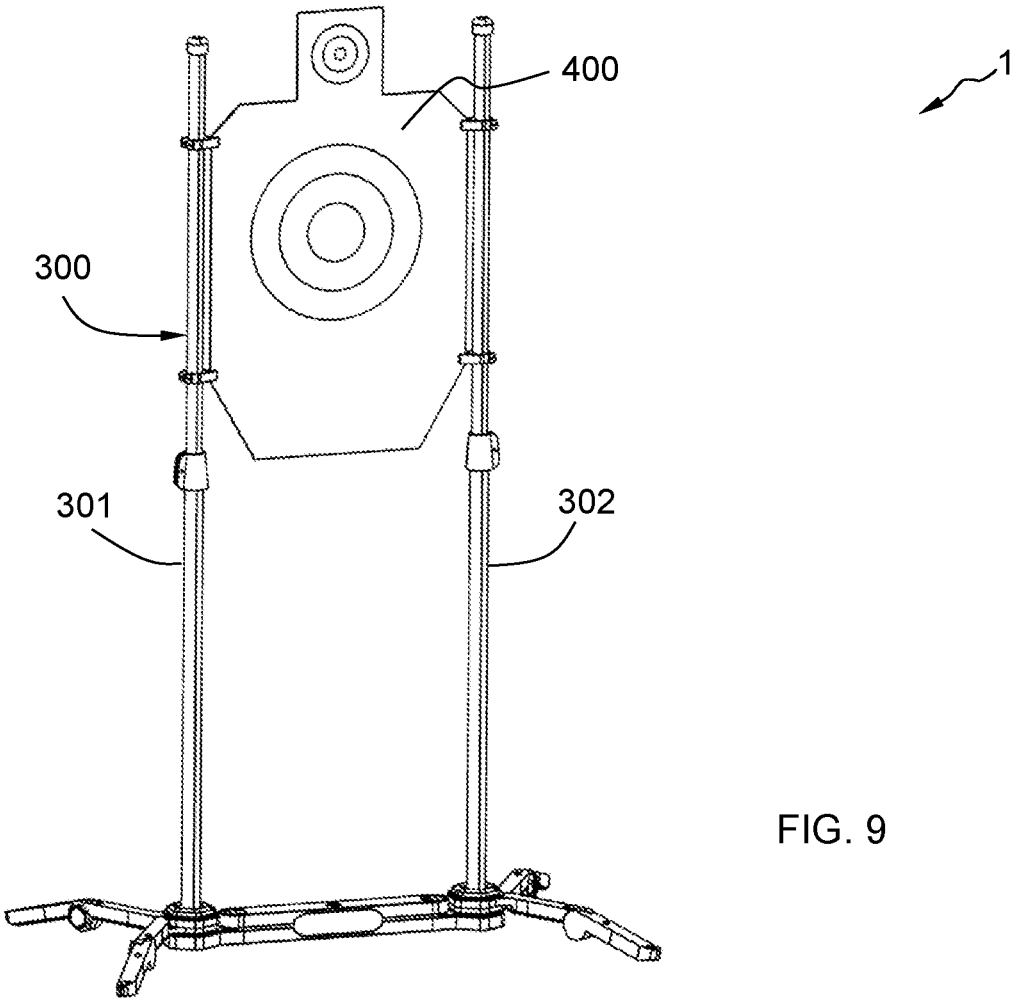
FIG. 9 is a perspective view of an embodiment of the portable target stand.

FIG. 9 shows a second exemplary embodiment wherein the portable target stand 1 further comprises a target assembly 300 having a first pole 301 and a second pole 302, so that, when in a mounted position, said first pole 301 is inserted in the first mounting hole 101, and said second pole 302 is inserted in the second mounting hole 102 of the base. Each of the two poles 301, 302 are formed by two tubes that can be assembled together, and both poles 301, 302 are configured for holding a target 400 between them.

Figure 10:
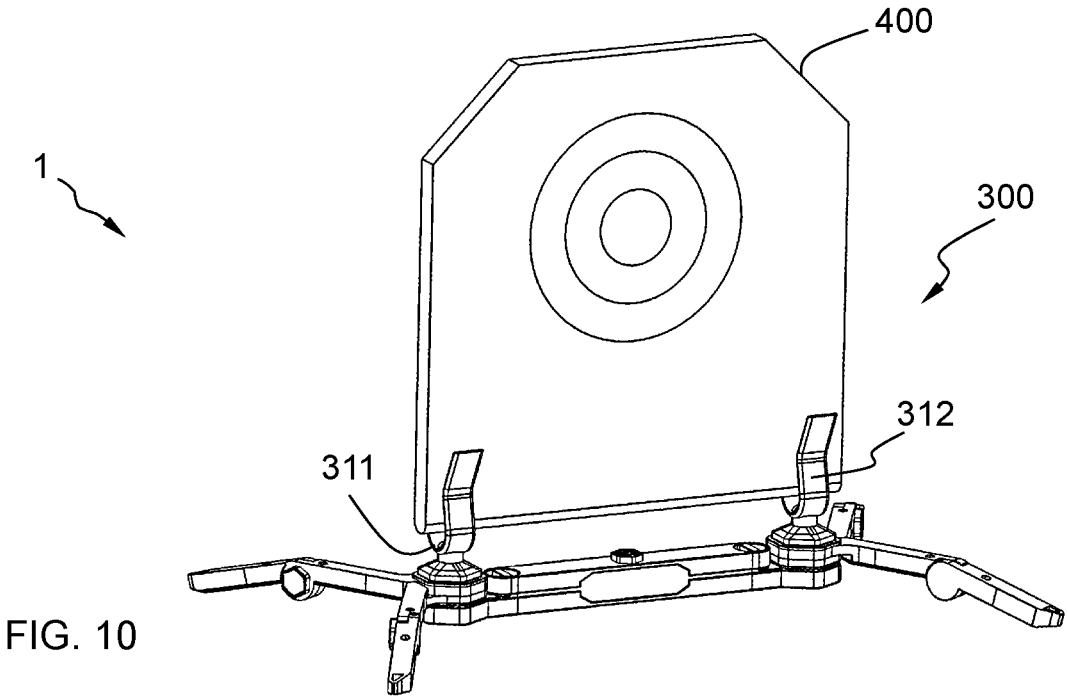
FIG. 10 is a perspective view of an embodiment of the portable target stand.

FIG. 10 shows a third exemplary embodiment of the portable target stand 1 according to the invention. In this embodiment, the target stand 1 comprises a target assembly 300 that has a first clamp 311 and a second clamp 312. Each clamp 311, 312 having a bottom straight mounting part and top clamping part having the general shape of an inverted R. In a mounted position, the straight mounting part of said first clamp 311 is inserted in the first mounting hole 101 of the base, and the straight mounting part of said second clamp 312 is inserted in the second mounting hole 102. As shown in FIG. 10, the clamps 311, 312 configured for holding a target 400 between them.

Figure 11:
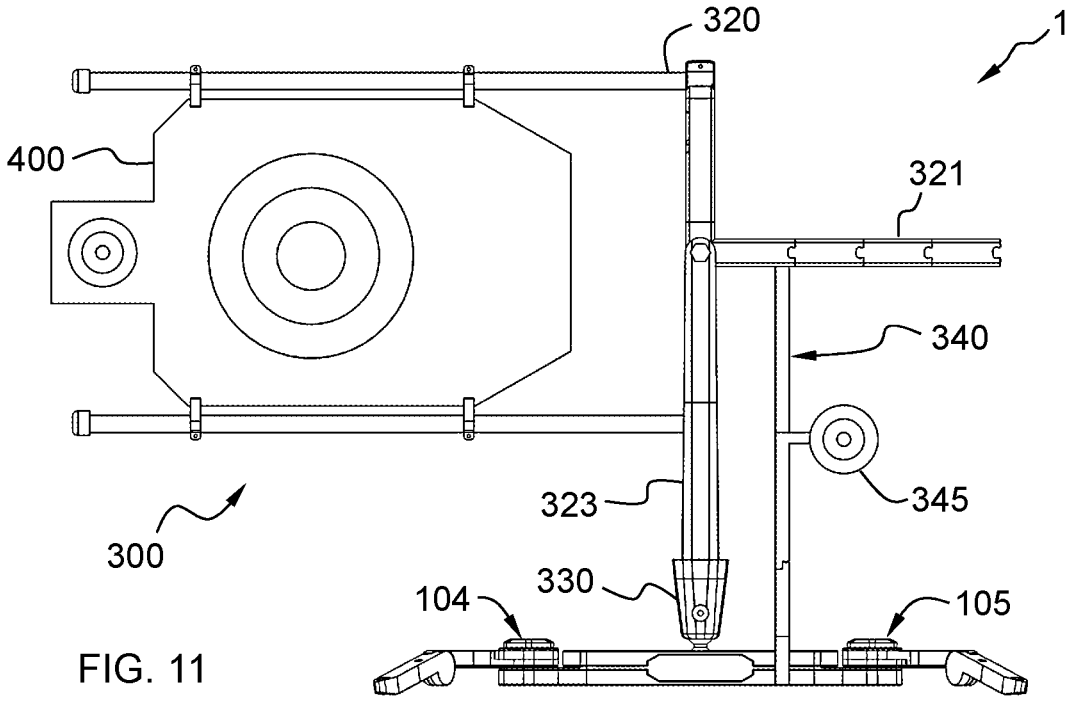
FIG. 11 is a front view of an embodiment of the portable target stand with a pendulum target assembly.
Figure 12:
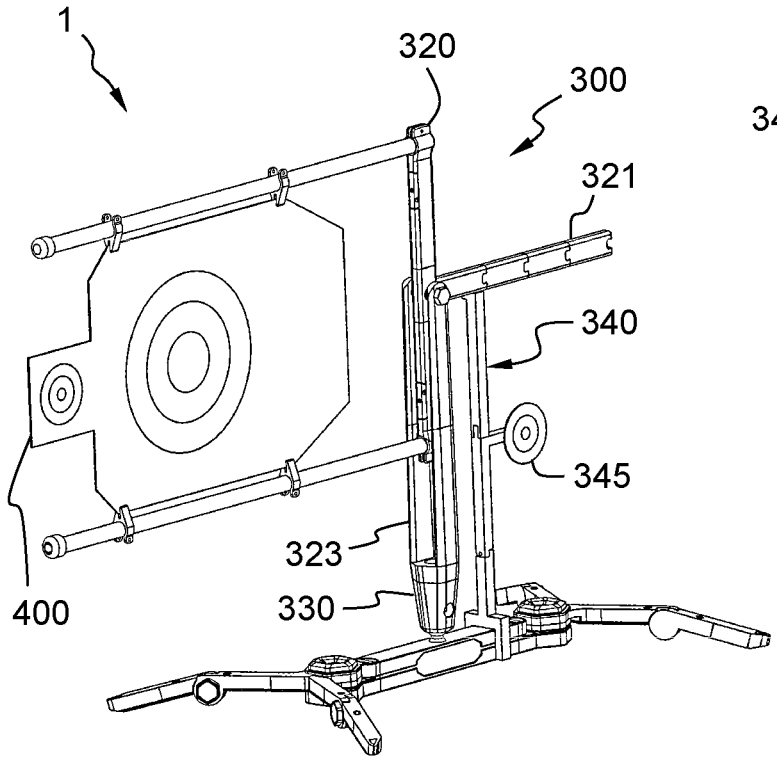
FIG. 12 is a perspective view of the portable target stand of FIG. 11.
Figure 16:
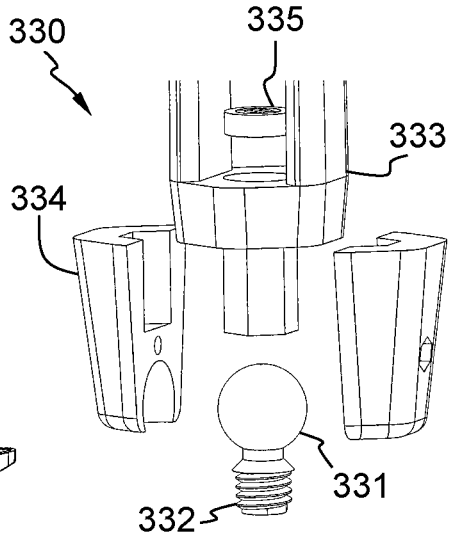
FIG. 16 is an exploded detail view of a ball joint used in some embodiments.

FIG. 11 and FIG. 12 show a fourth exemplary embodiment of the portable target stand 1 according to the invention, that further comprises a pendulum target assembly 300 that comprises a U-shaped holding structure 320 which is configured to hold a target 400. The holding structure 320 is connected to a counterweight 321, and rotatably attached to a vertical fork 322, so that it can oscillate vertically following a pendular movement. As shown in the figures, the counterweigh 321 is a pole formed by one or more weight elements that can be assembled together. The target assembly 300 further comprising a ball joint 330, shown in detail in FIG. 16. The ball joint 330 has a ball 331 connected to a threaded bottom shaft 332 that can be inserted in the central mounting hole 103 of the base. The ball joint 300 further has an upper part 333 provided with a spirit level 335, and a clamp 334 used to clamp the upper 333 part to the ball 331. The vertical fork 323 of the target assembly 300 is attached to said upper part 333 of said ball joint 330. The ball joint 300 of the embodiment further comprises a bolt and a nut configured for jointly block the clamp 334 in position clamping the ball 311. For the sake of clarity, said bolt and nut have not been represented in FIG. 16.

Figure 13:
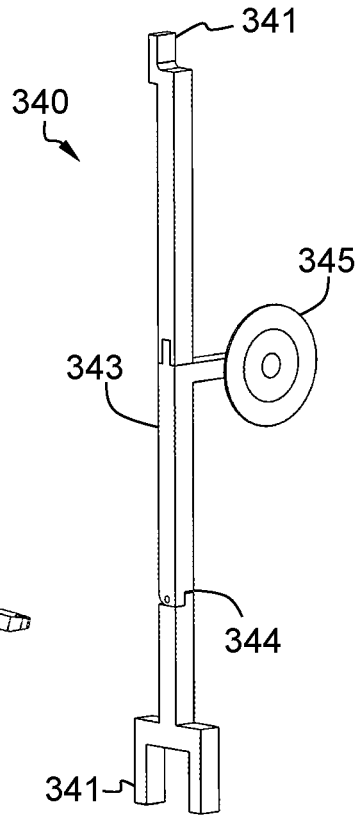
FIG. 13 is a detail view of the locking bracket of the target stand of FIG. 11.

In the fourth exemplary embodiment, the target assembly 300 further comprises a locking bracket 340 that is detailed in FIG. 13. In particular, the locking bracket 340 has a first L-shaped end 341 that is configured to engage with the counterweight 321, a second U-shaped end 342 that is configured to engage with the elongated body 100, and a straight pole 343 connecting the first L-shaped end 341 and the second U-shaped end 342 and that has an intermediate articulation 344, so that the upper part of the straight pole 343 can be tilted backwards. Each of the two parts of the straight pole 343 separated by the articulation 344, may be formed each in a single piece, or by joining different pieces assembled together. As shown in FIG. 11 and FIG. 12, in a mounted position, the holding structure 320 and the counterweight 321 are in a horizontal position, and the locking bracket 340 is vertically arranged between the elongated body 100 and the counterweight 321 thus securing said counterweight 321 in a horizontal position, the target assembly 300 further comprises a releasing actuator, in particular, a secondary target 345 attached to said straight pole 343, so that when it receives a shot, it throws down the locking bracket 340, thereby releasing said counterweight 321. Other releasing actuators may be envisaged, as a non-limiting example, a cord attached to one end 341, 342 of the locking bracket 340.

Figure 14:
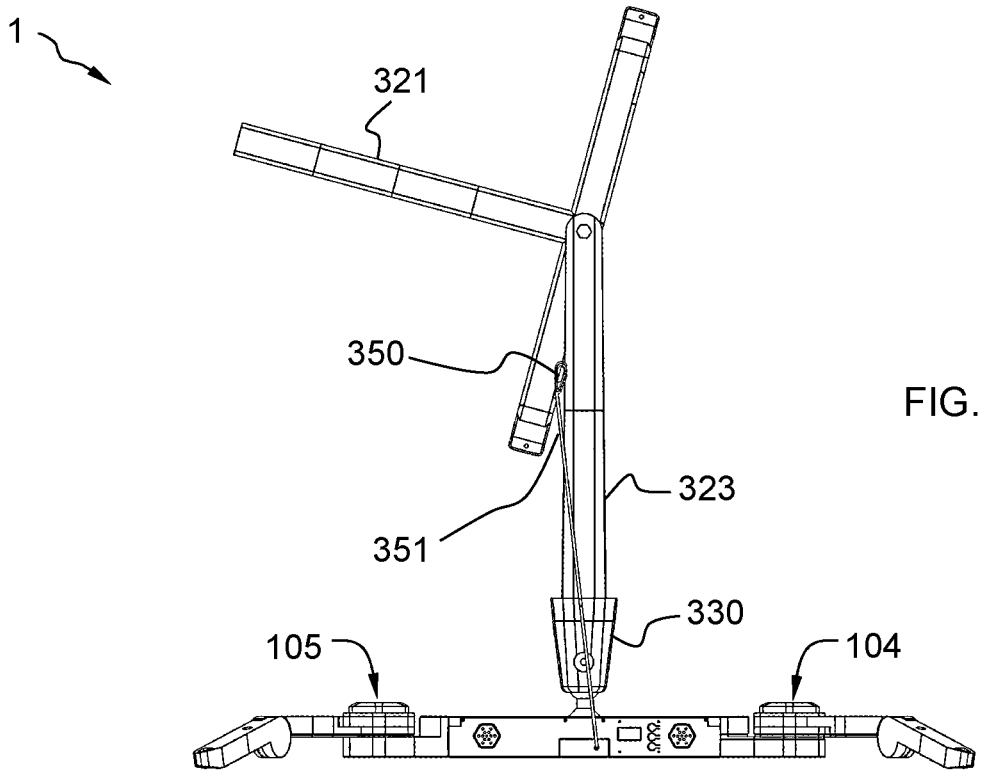
FIG. 14 is a back view an embodiment of the portable target stand with another target assembly. For the sake of clarity, part of the U-shaped holding structure has been removed, in particular, the two parallel vertical shafts.
Figure 15:
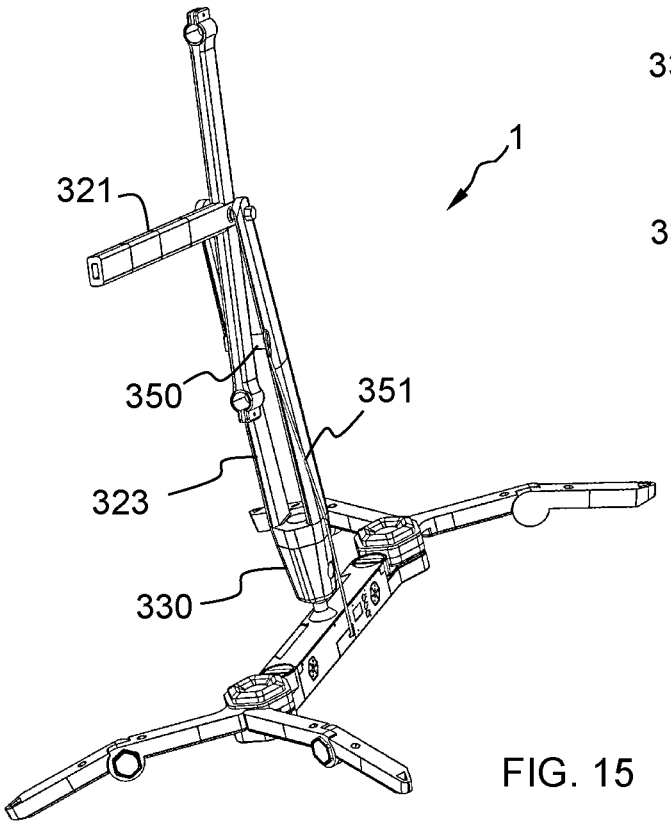
FIG. 15 is a perspective view of the portable target stand of FIG. 14.

FIG. 14 and FIG. 15 show a fifth embodiment of a portable target stand 1 according to the invention. This embodiment also has a U-shaped holding structure 320, a vertical fork 323 and a ball joint 330 as in the fourth embodiment. However, instead of a locking bracket 340, the fifth embodiment has a locking latch 350, provided in said U-shaped holding structure 320, in particular, in the pole that forms the bottom of the U. For the sake of clarity, the two parallel poles of the U-shaped holding structure 320 are not shown in FIG. 14 and FIG. 15, so that the difference is more clearly distinguishable. These figures shown the assembly in a locked position wherein the locking latch 350 extends perpendicularly from the holding structure 320 and engages with the vertical fork 323 thus securing said U-shaped holding structure 320 in an approximate horizontal position. The locking latch 350 is rotatably mounted to said U-shaped holding structure 320 between the locking position shown in the figures, and an unlocked position wherein said locking latch 350 is folded to the holding structure 320 and retained thereto by two magnets. The target assembly 300 further comprises a releasing actuator, in particular, a cord 351 attached to one end of the locking latch 350, which is configured to pull down said locking latch 350 from its ends, thereby moving the latch 350 from the locked position to the unlocked position wherein it is then hold by the magnets. This way, the U-shaped holding structure 320 is released and the target assembly 300 starts oscillating vertically in a pendular motion.

In this fifth embodiment, the elongated body 100 further has a control module shielded inside it. Said control module is configured for:

- activating or deactivating at least one light and/or one laser pointer provided in said body 100;
- driving at least one speaker provided in said body 100 to emit sounds; and
- activating the cord which pulls down a locking latch 350 from one of its ends, thereby releasing a holding structure 320 of a pendulum target assembly 300.

The control module is configured for performing at least one pre-defined sequence which may be stored and or/programmable and also user selectable by a remote control and/or an app in a smart device that communicates with the control module using Wi-Fi, Bluetooth, or any other suitable wireless communication, so that the remote control can be remotely activated/deactivated and controlled.

In another embodiment derived from the fourth embodiment, an equivalent control module is used with the same functionalities that in the fifth module but configured for activating a releasing actuator which in turn throws down a locking bracket thereby releasing a counterweight of a pendulum target assembly 300.

Figure 17:
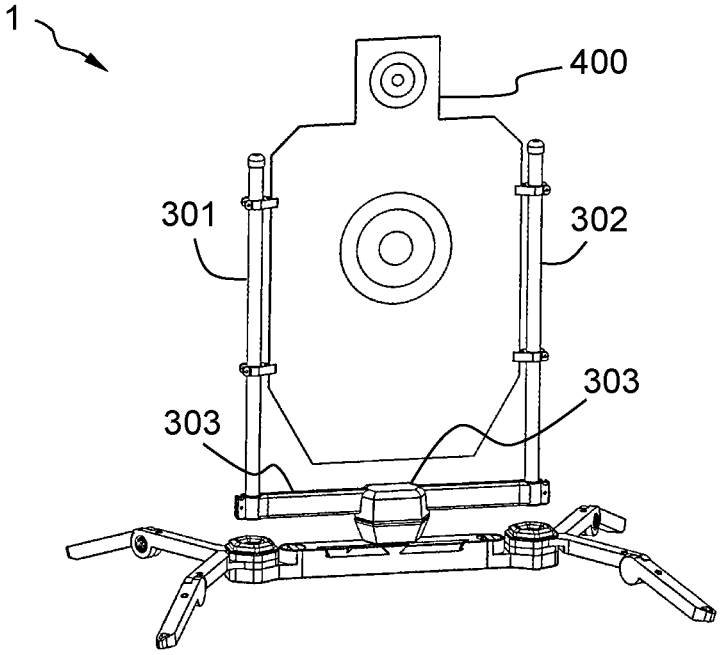
FIG. 17 is a perspective view of an embodiment of the portable target stand.

In a sixth exemplary embodiment shown in FIG. 17, the target stand 1 comprises a rotatory vertical target assembly 300 having a U-shaped holding structure 320 which is configured to hold a target 400. Said holding structure 320 has two vertical poles 301, 302 and a horizontal bottom part 303; said target assembly 300 further comprising a rotatory module 304 which is configured to be inserted in the central mounting hole 103. The rotatory module 304 is provided with attaching means that are configured for firmly attaching the bottom part 303, and that also allow to detach them for unmounting the target stand 1. The rotatory module 304 also has internal rotatory means, arranged for rotating around a vertical axis, so that, when they rotate, they also drive the U-shaped holding structure 300 to rotate around said vertical axis. The body 100 is provided with internal rotation driving means, controlled by a control module, and configured to drive said rotatory means to rotate. Therefore, the rotatory vertical target assembly 300, rotates around the vertical axis, so that the area shown to the person practicing shooting is reduced at times, and the practice becomes more challenging.

Figure 18:
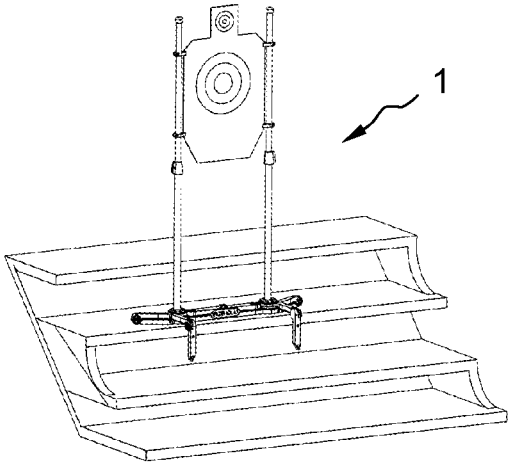
FIG. 18, FIG. 19, and FIG. 20 are perspective views of target stands according to the invention deployed in different surfaces.
Figure 19:
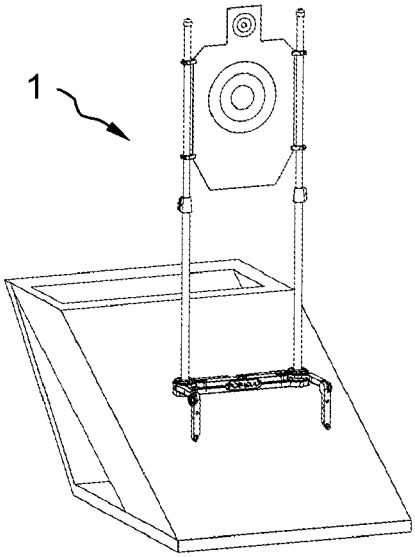
Figure 20:
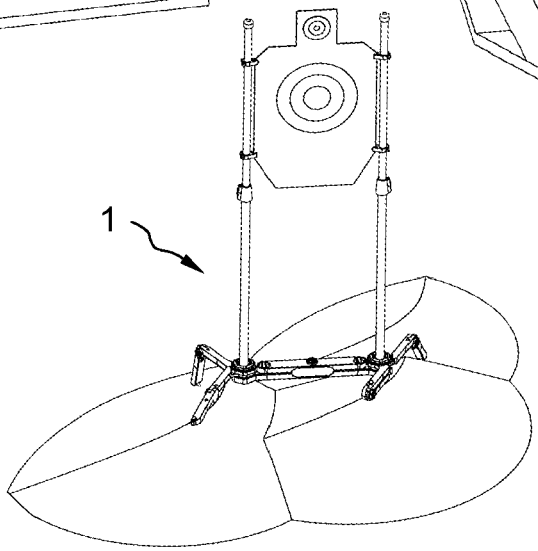

FIG. 18, FIG. 19, and FIG. 20 are examples of portable target stands deployed on different uneven surfaces. In the figures it is shown the advantageous adaptation to the terrain given by the technical features of the stand, in particular, the four independent legs, each having a horizontal folding portion and a vertical folding portion. As it can be seen in the figures, the target stand is capable to be deployed in a variety of terrains by folding or unfolding each leg and each portion thereof when necessary.

The invention claimed is:

1. A portable target stand comprising a base aimed to be deployed over a surface in a usage position, said base comprising:

- an elongated body, extending horizontally between a first end and a second end in said usage position; and
- four legs;
- said body having target attaching means, configured to attach at least one target assembly thereto, wherein said target assembly comprises means for holding at least a target;
- each of said legs comprising:
- a first portion, attached to said body so that is horizontally tiltable between a first folded position wherein said first portion is folded to said body, and a first extended position wherein said first portion is tilted away laterally from said body; and
- a second portion, attached to said first portion so that is vertically tiltable between a second folded position wherein said second portion is folded to said first portion, and a second extended position wherein said second portion is tilted away downwards from said first portion in an angle of at least 90°.

2. The portable target stand according to claim 1, wherein in each leg, said first portion is attached to said second portion by means of a toothed hirth-like joint.

3. The portable target stand according to claim 1, wherein each of said first portions is attached to said body by means of a swivel attachment, and wherein said body comprises:

a first swivel attachment proximate to said first end of the body; and a second swivel attachment proximate to said second end of the body;

wherein said four legs are grouped in two pairs of legs, a first pair of legs of said four legs, attached to said first swivel attachment, and a second pair of legs of said four legs, attached to said second swivel attachment.

4. The portable target stand according to claim 3, wherein said elongated body comprises:

a central part;

a first end part comprising said first swivel attachment; and a second end part comprising said second swivel attachment;

wherein each of said first end part and said second end part are removably attachable to said central part by means of respective end part securing means; each of said end part securing means comprising a dovetail junction and a lock.

5. The portable target stand according to claim 3, wherein, for each pair of legs of said two pairs of legs, one leg of said pair of legs is horizontally tiltable from said first folded position to said first extended position in a forward direction, and the other leg of said pair of legs is horizontally tiltable from said first folded position to said first extended position in a backward direction, contrary to said forward direction.

6. The portable target stand according to claim 3, wherein, for each pair of legs of said two pairs of legs, it is provided an angular stopper configured to prevent the angle between said legs from being less than a predefined minimum angle, so that each leg of said pair of legs is horizontally tiltable independent from one another if the angle between each leg of said pair of legs is greater than said predefined angle between legs.

7. The portable target stand according to claim 3, wherein each swivel attachment of said first swivel attachment and said second swivel attachment comprises a top threaded part and a bottom threaded part, screwable with each other in a mounted position, thereby forming a vertical empty cylinder having a central axis, said empty cylinder opened to the exterior at least in a top side of said elongated body, so that a mounting hole accessible by said top side is formed, wherein said central axis of said vertical cylinder is also the axis of rotation around which each leg of the pair of legs attached to the swivel attachment can be tilted;

wherein said target attaching means comprises:

a first mounting hole, being the mounting hole corresponding to said first swivel attachment; and a second mounting hole, being the mounting hole corresponding to said second swivel attachment.

8. The portable target stand according to claim 7, further comprising a target assembly that comprises a first pole and a second pole, wherein, in a mounted position, said first pole is inserted in said first mounting hole, and said second pole is inserted in said second mounting hole, said poles configured for holding a target between them.

9. The portable target stand according to claim 7, further comprising a target assembly that comprises a first clamp and a second clamp, each clamp having a bottom straight mounting part and top clamping part having the general shape of an inverted R, wherein, in a mounted position, said straight mounting part of said first clamp is inserted in said first mounting hole, and said straight mounting part of said second clamp is inserted in said second mounting hole, said clamps configured for holding a target between them.

10. The portable target stand according to claim 1, wherein said target attaching means comprise a central mounting hole provided in a top side of said elongated body.

11. The portable target stand according to claim 10, further comprising a pendulum target assembly that comprises a U-shaped holding structure configured to hold a target, said holding structure connected to a counterweight, and rotatably attached to a vertical fork, so that it can oscillate vertically;

said target assembly further comprising a ball joint, having:

a ball connected to a bottom shaft which is configured to be inserted in said central mounting hole;

an upper part; and a clamp, configured to clamp the upper part to the ball;

wherein said vertical fork is attached to said upper part of said ball joint; and wherein said target assembly further comprises a spirit level, configured to show the inclination of said upper part of said ball joint.

12. The portable target stand according to claim 11, wherein said counterweigh comprises a pole, said pole comprising one or more weight elements that can be assembled together thereby forming said pole.

13. The portable target stand according to claim 11, wherein said target assembly further comprises a locking bracket comprising:

a first L-shaped end, configured to engage with said counterweight of said target assembly;

a second U-shaped end, configured to engage with said elongated body; and a straight pole connecting said first L-shaped end and said second U-shaped end;

wherein, in a mounted position, said holding structure and said counterweight are in a horizontal position, and said locking bracket is vertically arranged between the elongated body and the counterweight thus securing said counterweight in a horizontal position; and wherein said straight pole comprises an intermediate articulation, so that the upper part of the pole can be tilted backwards.

14. The portable target stand according to claim 13, wherein said target assembly further comprises a releasing actuator, configured to throw down said locking bracket, thereby releasing said counterweight, wherein said releasing actuator comprises at least one of:

a secondary target attached to said straight pole; and a cord attached to one end of said locking bracket.

15. The portable target stand according to claim 11, wherein said target assembly further comprises a locking latch, provided in said U-shaped holding structure of said target assembly and configured for engaging with said vertical fork thus securing said U-shaped holding structure in a horizontal position;

wherein said locking latch is rotatably mounted to said U-shaped holding structure and has an unlocked position wherein said locking latch is folded to the U-shaped holding structure and retained thereto by at least one magnet, and a locked position wherein said locking latch extends perpendicularly to the U-shaped holding structure.

16. The portable target stand according to claim 15, wherein said target assembly further comprises a releasing actuator, configured to pull down said locking latch from one of its ends, so that said locking latch is moved from said locked position to said unlocked position, thereby releasing said U-shaped holding structure, wherein said releasing actuator comprises a cord configured to be attached to one end of said locking latch.

17. The portable target stand according to claim 10, further comprising a rotatory vertical target assembly that comprises a U-shaped holding structure configured to hold a target, said holding structure comprising two vertical poles and a horizontal bottom part; said target assembly further comprising a rotatory module configured to be inserted in said central mounting hole and having:

attaching means, configured for removably attaching said bottom part; and rotatory means, configured for rotating around a vertical axis, thereby driving said U-shaped holding structure to rotate around said vertical axis;

wherein said elongated body is provided with rotation driving means configured to drive said rotatory means to rotate.

18. The portable target stand according to claim 1, wherein said elongated body further comprises a control module shielded inside said elongated body, said control module being configured for performing at least one of:

activating or deactivating at least one light provided in said body;

activating or deactivating at least one laser pointer provided in said body;

driving at least one speaker provided in said body to emit at least one sound;

activating a releasing actuator which in turn throws down a locking bracket thereby releasing a counterweight of a pendulum target assembly; and activating a releasing actuator which in turns pulls down a locking latch from one of its ends, thereby releasing a holding structure of a pendulum target assembly;

wherein said control module is configured for performing at least one pre-defined sequence.

19. The portable target stand according to claim 1, wherein it is manufactured using at least one plastic material, said at least one plastic material has at least all but one of the following properties:

Young's Modulus: 0.1 to 2.9 GPa;

Tensile Resistance: 10 to 80 MPa;

Shear Modulus: 85 to 100 MPa;

Shore Hardness (D scale): 50 to 80; and

Glass-transition Temperature: −125 to 40° C.

20. The portable target stand according to claim 1, wherein it is manufactured using at least one of:

nylon;

polyethylene;

polypropylene;

acrylonitrile butadiene styrene; and polyvinyl chloride foam.

* * * * *